US007706702B2

(12) United States Patent
Yamagata

(10) Patent No.: US 7,706,702 B2
(45) Date of Patent: Apr. 27, 2010

(54) IMAGE FORMING APPARATUS WITH A DEVELOPER DETERMINATION SYSTEM

(75) Inventor: Kazuhiro Yamagata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 214 days.

(21) Appl. No.: 11/840,509

(22) Filed: Aug. 17, 2007

(65) Prior Publication Data

US 2008/0219686 A1 Sep. 11, 2008

(30) Foreign Application Priority Data

Aug. 22, 2006 (JP) ..... 2006-225450

(51) Int. Cl.
*G03G 15/08* (2006.01)

(52) U.S. Cl. ..... 399/27; 399/254

(58) Field of Classification Search ..... 399/27, 399/53, 61, 64, 254
See application file for complete search history.

(56) References Cited

U.S. PATENT DOCUMENTS 5,587,770 A 12/1996 Jo et al.
6,456,810 B1 * 9/2002 Deguchi et al. ..... 399/254
6,501,933 B2 * 12/2002 Ishii ..... 399/254
2004/0086286 A1 5/2004 Ishii et al.

FOREIGN PATENT DOCUMENTS

| | | |
|---|---|---|
| JP | 7261537 | 10/1995 |
| JP | 2002372847 | 12/2002 |
| JP | 2003-029508 | 1/2003 |
| JP | 2003209508 | 1/2003 |
| JP | 2004029396 | 1/2004 |

* cited by examiner

*Primary Examiner*—Sandra L Brase
(74) *Attorney, Agent, or Firm*—Banner & Witcoff, Ltd

(57) ABSTRACT

A product of a predetermined time interval and the number of periods is set to be an integer multiple of a time (or agitation period) required for one rotation of an agitation member and also a light receiving state is detected when an interval signal is Hi. Therefore, the number of times that light cannot be received due to the agitation member (or the number of agitation influences) is constant within one period. Since the number of agitation influences is set to the constant number of times in one period and the influence of the agitation member is constant at the remaining developer amount ratio of 1/Light Receiving Ratio, the light receiving ratio appropriately indicating the remaining developer amount can be obtained and the remaining developer amount can be correctly detected.

2 Claims, 7 Drawing Sheets

IMAGE FORMING APPARATUS WITH A DEVELOPER DETERMINATION SYSTEM

CROSS REFERENCE TO RELATED APPLICATION

The present application claims priority from Japanese Patent Application No. 2006-225450, which was filed on Aug. 22, 2006, the disclosure of which is herein incorporated by reference in its entirety.

TECHNICAL FIELD

The present invention relates to an image forming apparatus of an electrophotograph system.

BACKGROUND

JP-A-2004-29396 discloses an image forming apparatus of an electrophotograph system, which forms an image by transferring a developer image to a recording sheet. The image forming apparatus uses a developer accommodated within a developer casing such as a process cartridge. To detect an amount of the developer remaining within the developer casing, the image forming apparatus has a light emitting element and a light receiving element, which are provided at respective ends in a width direction of the developer casing (or process cartridge), so that the light receiving element receives light emitted from the light emitting element and passing through the developer casing. To detect whether the light receiving element received the light, an output voltage of the light receiving element is monitored at every predetermined time interval (5 msec).

Based on the output voltage monitored thus, the image forming apparatus computes a ratio of a number of times the light receiving element received the light relative to the predetermined number of times of monitoring (e.g. 400 times). Hereinafter, the ratio is referred to as the light receiving ratio. If the light receiving ratio is less than 2%, the image forming apparatus determined that an amount of the developer in the developer casing is sufficient. If the light receiving ratio is more than 20%, the image forming apparatus determines that an amount of the developer in the developer casing is depleted.

SUMMARY

However, the image forming apparatus disclosed in JP-A-2004-29396 suffers from the following problem. An agitator (or agitation member) rotated in a developer casing for agitating the developer periodically blocks an optical path from the light emitting element to the light receiving element.

Since the output voltage of the receiving element changes corresponding to a state in which the light receiving element receives the light, the computed light receiving ratio involves not only the number of times in which the optical paths is blocked by the developer but also the number of times in which the optical path is blocked by the agitator.

Therefore, the light receiving ratio computed in accordance with JP-A-2004-29396 cannot accurately indicate an amount of the developer in the developer casing.

Accordingly, one of the objects of the invention is to provide an image forming apparatus that can accurately detect an amount of the developer remaining in the developer casing.

According to an aspect of the invention, there is provided an image forming apparatus of an electrophotograph system for forming an image on a recording sheet by transferring a developer image to the recording sheet. The image forming apparatus includes a developer casing which accommodates a developer, an agitation member which is provided to be rotated in the developer casing and agitates the developer, a light emitting unit which is arranged at one end in a rotation axis direction of the agitation member and which emits light to the other end in the rotation axis direction of the agitation member through the developer casing, a light receiving unit which is arranged at the other end in the rotation axis direction of the agitation member and receives the light emitted from the light emitting unit, a signal output unit which outputs an interval signal at a predetermined time interval, a light reception determination unit which determines whether light has been received in the light receiving unit when the interval signal has been output, a counting unit which sets a predetermined number of times of outputting to one period and counts a number of times the interval signal is output, and a remaining amount determination unit which determines an amount of the developer remaining in the developer casing on a basis of a ratio of a number of times of determining, by the light reception determination unit, that light has been received in the light receiving unit within the one period and the predetermined number of times of outputting. A product of the predetermined time interval and the predetermined number of times of outputting is set to be an integer multiple of a time required for one rotation of the agitation member.

According to the aspect of the invention, the product of the predetermined time interval and the predetermined number of time of outputting is set to be integer multiple of the time (hereinafter, the time is referred to as agitation period) in which the agitation member needs for one rotation. Therefore the number of times agitation member blocks the light with in the one period (hereinafter, this number of times is referred to as the number of agitation influences) is set to a constant number of times.

According to JP-A-2004-29396, a product of a predetermined time interval (5 msec) and the predetermined number of times of monitoring (400 times) is not set to be an integer multiple of an agitation period. Therefore, the number of agitation influences within one period is not set to the constant number of times, and the number of agitation influences in the light receiving ratio changes every time the agitation member rotates. For this reason, since it is difficult to obtain a light receiving ratio accurately indicating an amount of the developer in the developer casing for the image forming apparatus disclosed in JP-A-2004-29396, and the image forming apparatus cannot accurately detect the amount of the developer in the developer casing.

According to one aspect of the invention, the number of agitation influences within the one period is set to the constant number of times. Therefore, the influence of the agitation member in the light receiving ratio is constant every time the agitation member rotates. The light receiving ratio computed by the image forming apparatus in the invention accurately indicates an amount of the developer remaining in the developer casing.

DETAILED DESCRIPTION OF THE PREFERRED EMBODIMENTS

Exemplary embodiments of an image forming apparatus in accordance with the invention are applied to a so-called laser printer, and will be described below with reference to the accompanying drawings.

First Embodiment

1. Overall Structure of Laser Printer

Figure 1:
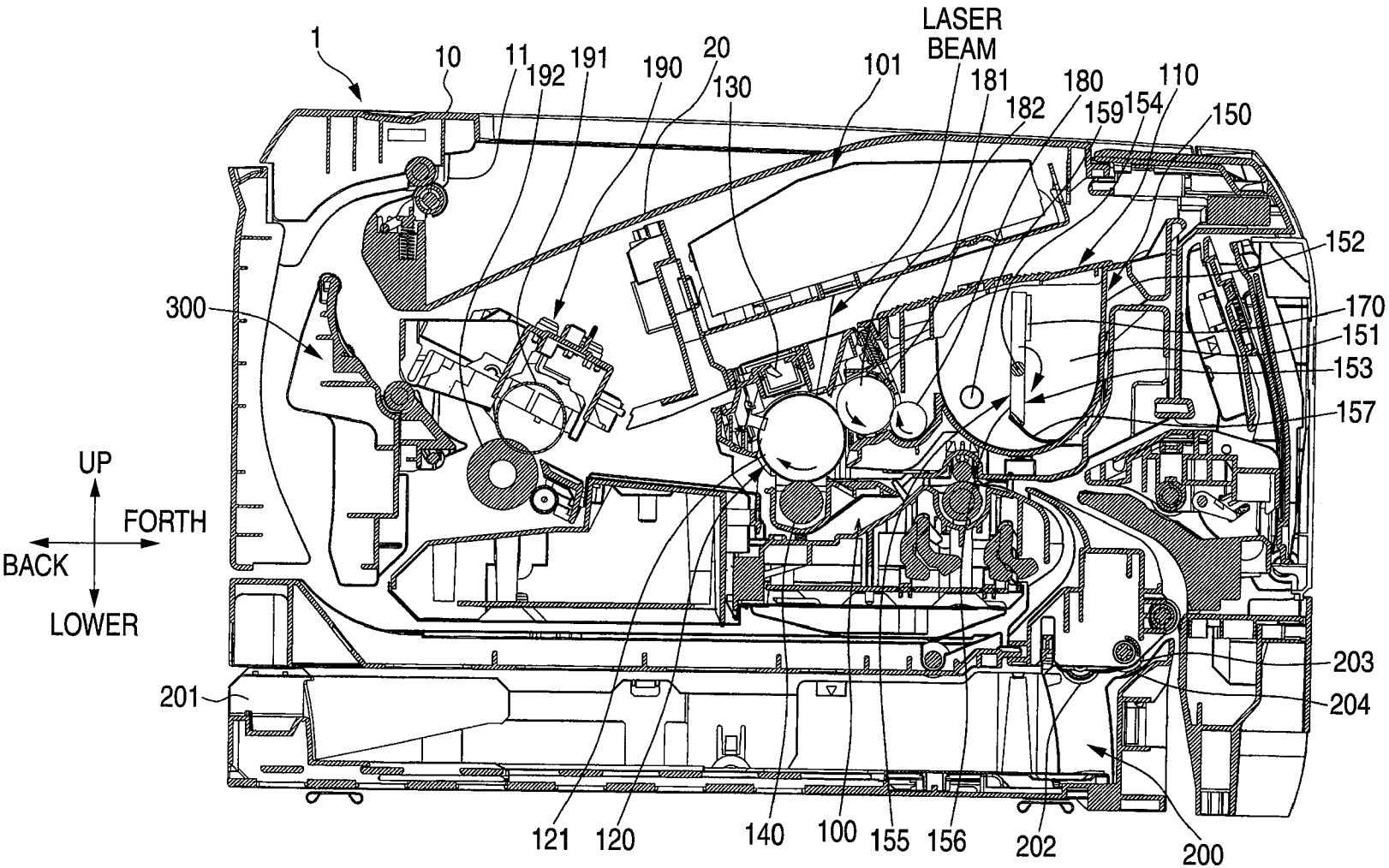
FIG. 1 is a side sectional view illustrating a laser printer 1 in accordance with an exemplary embodiment of the present invention.

FIG. 1 is a side sectional view illustrating a laser printer 1.

A housing 10 of the laser printer 1 is formed in a box shape (or cube shape). A sheet discharging tray 20 is disposed at the upper side of the housing 10. Sheets discharged from the housing 10 are stacked in the sheet discharging tray 20. In this exemplary embodiment, the sheet is considered to be a recording sheet such as a paper, an overhead projector (OHP) sheet, or the like.

2. Internal Structure of Laser Printer

The housing 10 contains an image forming portion 100 for forming an image on the sheet, a feeder portion 200 which can serve as a conveying unit for feeding the sheet to the image forming portion 100 and a discharge chute 300 which can serve as a guiding member for guiding the sheet on which the image is completely formed by the image forming portion 100.

2.1. Feeder Portion

The feeder portion 200 includes a sheet feeding tray 201 contained at a lowest part of the housing 10, a sheet feeding roller 202 for conveying the sheet to the image forming portion 100 provided at an upper side of a front end of the sheet feeding tray 201, a separation roller 203 and a separation pad 204 for separating sheets conveyed by the sheet feeding roller 202 one by one.

The sheet stacked in the sheet feeding tray 201 is conveyed to the image forming portion 100 arranged at a central part within the housing 10 such that the sheet makes a U turn to a front side within the housing 10.

2.2. Image Forming Portion

The image forming portion 100 is of an electrophotograph system. The image forming portion 100 includes a scanner portion 101, a process cartridge 110 and a fixing unit 190.

2.2.1. Scanner Portion

The scanner portion 101 is provided at an upper part of the housing 10. The scanner portion 101 forms an electrostatic latent image on a surface of a photosensitive drum 120 as described below. Specifically, the scanner portion 101 includes a laser light source (not illustrated), a polygon mirror (not illustrated), an fθlens (not illustrated) and a reflecting mirror (not illustrated).

The polygon mirror deflects a laser beam, when light is emitted from the laser light source based on image data. The reflecting mirror reflects an optical path after the laser beam passes through the fθ lens, so that the optical path is bent to a lower side. Thus, the laser beam is irradiated onto the surface of the photosensitive drum 120 to form the electrostatic latent image thereon.

2.2.2. Process Cartridge

Figure 2:
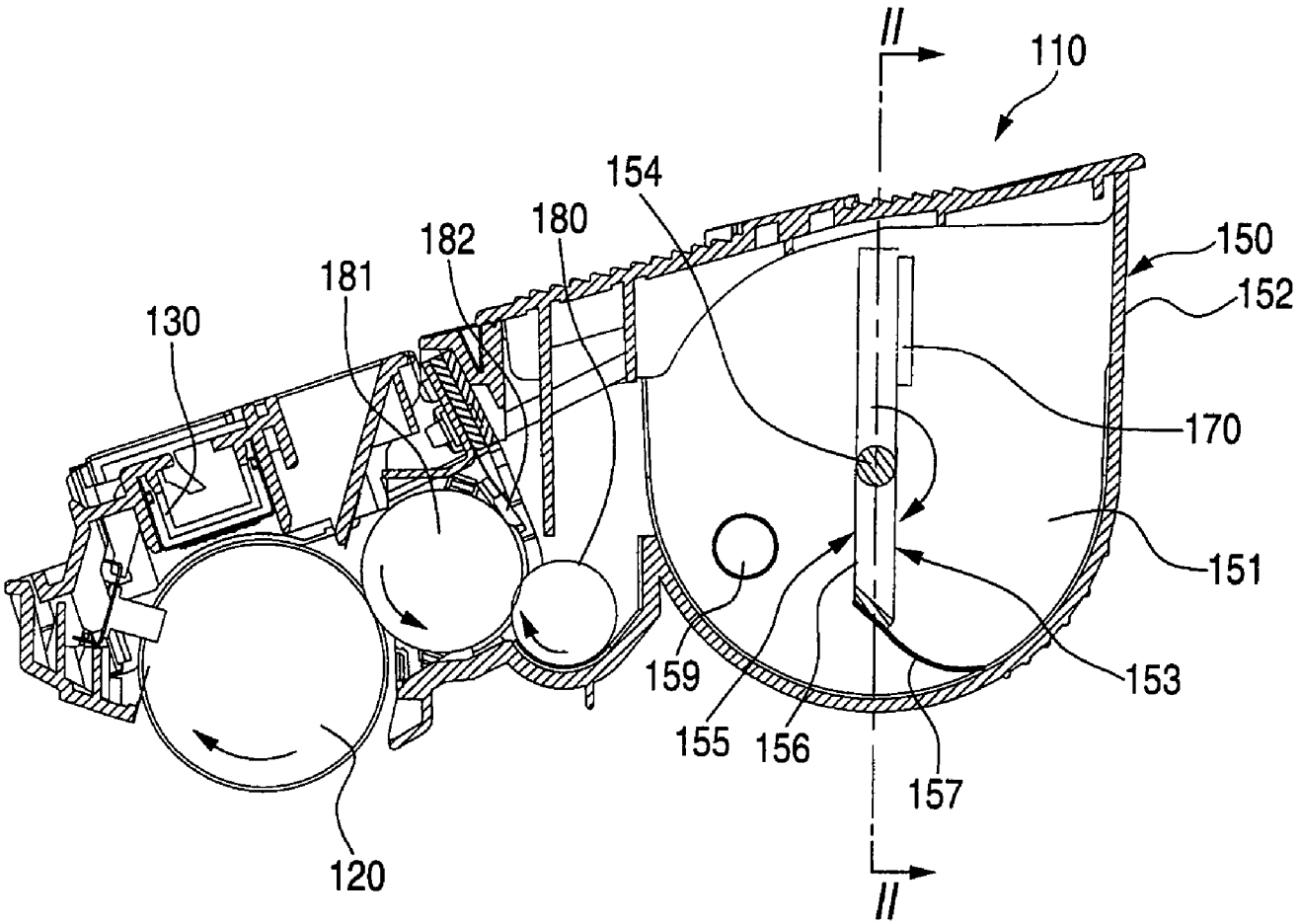
FIG. 2 is an enlarged sectional view illustrating a process cartridge 110 in accordance with an exemplary embodiment of the present invention.
Figure 3:
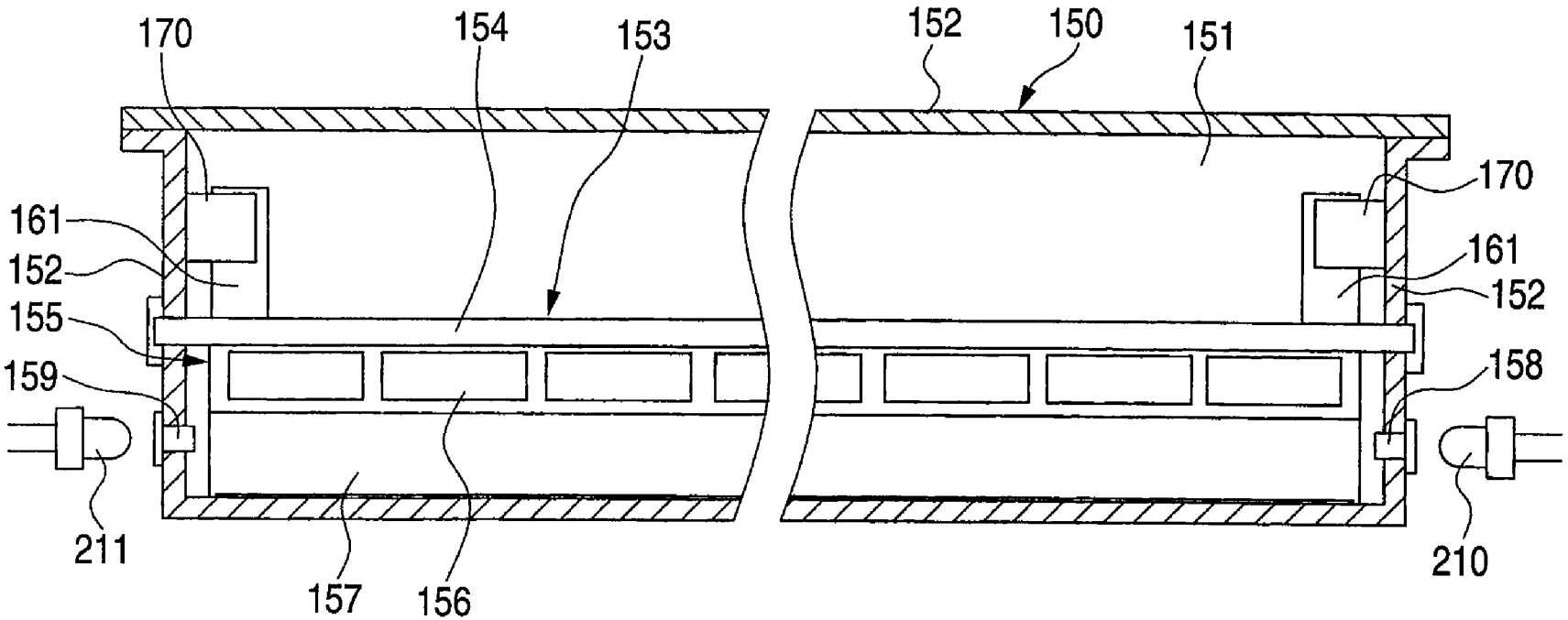
FIG. 3 is a II-II sectional view of FIG. 2.

FIG. 2 is an enlarged sectional view illustrating the process cartridge 110 and FIG. 3 is a II-II sectional view of FIG. 2.

As illustrated in FIG. 1, the process cartridge 110 is removable from and installable to the housing 10 at a lower side of the scanner portion 101. The process cartridge 110 includes a photosensitive drum 120, a charging unit 130 and a developer accommodating portion 150.

The photosensitive drum 120 carries an image to be transferred to the sheet. The photosensitive drum 120 includes a drum body 121 covered with a positively chargeable photosensitive layer. The drum body 121 is rotatably supported about a drum axis.

The charging unit 130 charges the surface of the photosensitive drum 120. The charging unit 130 is arranged opposite to the photosensitive drum 120. The charging unit 130 is spaced apart from the photosensitive drum 120 by a predetermined distance such that the charging unit 130 is not in contact with the photosensitive drum 120. In this exemplary embodiment, the charging unit 130 is a scorotron type charging unit for uniformly applying a positive electric charge to the surface of the photosensitive drum 120 using a corona discharge.

As illustrated in FIG. 1, a transfer roller 140 is arranged opposite to the photosensitive drum 120 and is rotated in conjunction with rotation of the photosensitive drum 120. When the sheet passes through around the photosensitive drum 120, the transfer roller 140 applies an electric charge having polarity opposite to an electric charge of the photosensitive drum 120 to the sheet from a side opposite to a printing surface, so that the transfer roller 140 transfers a developer image from the surface of the photosensitive drum 120 to the printing surface of the sheet.

As illustrated in FIG. 2, the developer accommodating portion 150 includes a casing 152 defining a developer accommodating space 151 for accommodating the developer (or toner). An agitation member (or agitator) 153 rotatably disposed in the casing 152 (or the developer accommodating space 151) agitates the developer accommodated in the developer accommodating space 151.

The agitation member 153 includes a rotation axis 154 rotatably supported in the casing 152, and an agitation portion 155 for agitating the developer accommodated in the developer accommodating space 151. The agitation portion 155 is integrally rotated with the rotation axis 154. The agitation portion 155 includes an agitation blade 156 for mainly agitating the developer and a conveying blade 157 for conveying the developer to a developer feeding roller 180.

The agitation blade 156 has a ladder shape in which multiple holes passing through in a rotational direction of the agitation member 153 (or a direction perpendicular to the sheet) are formed as illustrated in FIG. 3. The agitation member 153 is made of a rigid resin material such as ABS. The conveying blade 157 is a sheet-shaped member made of a resin having superior flexibility such as polyethylene terephthalate (PET), and is fixed to an end of the agitation blade 156 by adhesives.

A first light transmitting window 158 and a second light transmitting window 159 are arranged at both ends in an axis direction of the rotation axis 154 in the casing 152. The first light transmitting window 158 and the second light transmitting window 159 can transmit light such as infrared light and are arranged in a position located towards a lower side in a diameter direction (or in a direction perpendicular to the axis direction) from the rotation axis 154.

A light emitting element 210 for emitting light of a light emitting diode (LED) is arranged in a portion opposite to the first light transmitting window 158 of the body of the laser printer 1. A light receiving element 211 for emitting a signal when a photo transistor receives a light is arranged in a portion opposite to the second light transmitting window 159 of the body of the laser printer 1.

At both ends in a longitudinal direction of the rotation axis 154, a wiper 170 is arranged at a side opposite to the agitation portion 155 across the rotation axis 154. The wiper 170 wipes the surfaces of the first light transmitting window 158 and the second light transmitting window 159 inside the casing 152. The wiper 170 is attached to the rotation axis 154 via an arm 161.

In this exemplary embodiment, the wiper 170 is made of an elastic material such as urethane rubber and wipes the developer attached to the surfaces of the first light transmitting window 158 and the second light transmitting window 159 when an end of the wiper 170 is in contact with the first light transmitting window 158 and the second light transmitting window 159 while the wiper 170 is integrally rotated with the rotation axis 154. The wiper 170 prevents in advance light from being blocked in the first light transmitting window 158 or the second light transmitting window 159.

As illustrated in FIG. 2, a developer feeding roller 180 and a developing roller 181 for feeding the developer discharged from the developer accommodating space 151 in the conveying blade 157 are arranged between the developer feeding roller 180 and the photosensitive drum 120.

The developer discharged from the developer accommodating space 151 by the conveying blade 157 is fed to the developing roller 181 by rotation of the developer feeding roller 180. In addition, the developer fed to the developing roller 181 is supported on the surface of the developing roller 181 and the thickness of the developer supported is adjusted to the predetermined regular (or uniform) thickness by a layer thickness regulating blade 182. The developer is supplied to the surface of the photosensitive drum 120 exposed in the scanner portion 101.

A gear structure is contained in the casing 152. The gear structure transmits rotation driving force provided from the body of the laser printer 1 to the photosensitive drum 120, the agitation member 153, the developer feeding roller 180 and the developing roller 181 is contained. The photosensitive drum 120, the agitation member 153, the developer feeding roller 180 and the developing roller 181 are rotated while mechanically interlocking (or synchronizing) with the gear structure.

2.2.3. Fixing Unit

As illustrated in FIG. 1, the fixing unit 190 is arranged at a back stream side of the photosensitive drum 120 in a conveying direction of the sheet. The fixing unit 190 fixes the developer transferred to the sheet by heating and melting the developer. Specifically, the fixing unit 190 includes a heating roller 191 and a pressing roller 192. The heating roller 191 faces a printing side of the sheet. The pressing roller 192 faces a side opposite to the heating roller 191, for pressing the sheet to the side of the heating roller 191.

2.2.4. Overview of Image Forming Operation

In the image forming portion 100 as described above, an image is formed on the sheet as follows.

First, the surface of the photosensitive drum 120 is uniformly positively charged by the charging unit 130 according to its rotation. After charging, surface of the photosensitive drum 120 is exposed by a fast scan of a laser beam irradiated from the scanner portion 101. Therefore, an electrostatic latent image corresponding to the image to be formed on the sheet is formed on the surface of the photosensitive drum 120.

Subsequently, when the developer supported on the developing roller 181 and positively charged by the rotation of the developing roller 181 is in contact with the photosensitive drum 120, the developer is supplied to the electrostatic latent image formed on the surface of the photosensitive drum 120. That is, the developer is supplied to an exposure portion in which a potential is lowered by a laser beam in the surface of the photosensitive drum 120 uniformly positively charged. Therefore, the electrostatic latent image of the photosensitive drum 120 is visualized and a developer image is supported on the photosensitive drum 120.

Thereafter, the developer image supported on the surface of the photosensitive drum 120 is transferred to the sheet by a transfer bias applied to the transfer roller 140. Then, the sheet to which the developer image is transferred is conveyed to and heated in the fixing unit 190. The developer transferred as the developer image is fixed to the sheet and image formation is completed.

3. Structure of Control System

Figure 4:
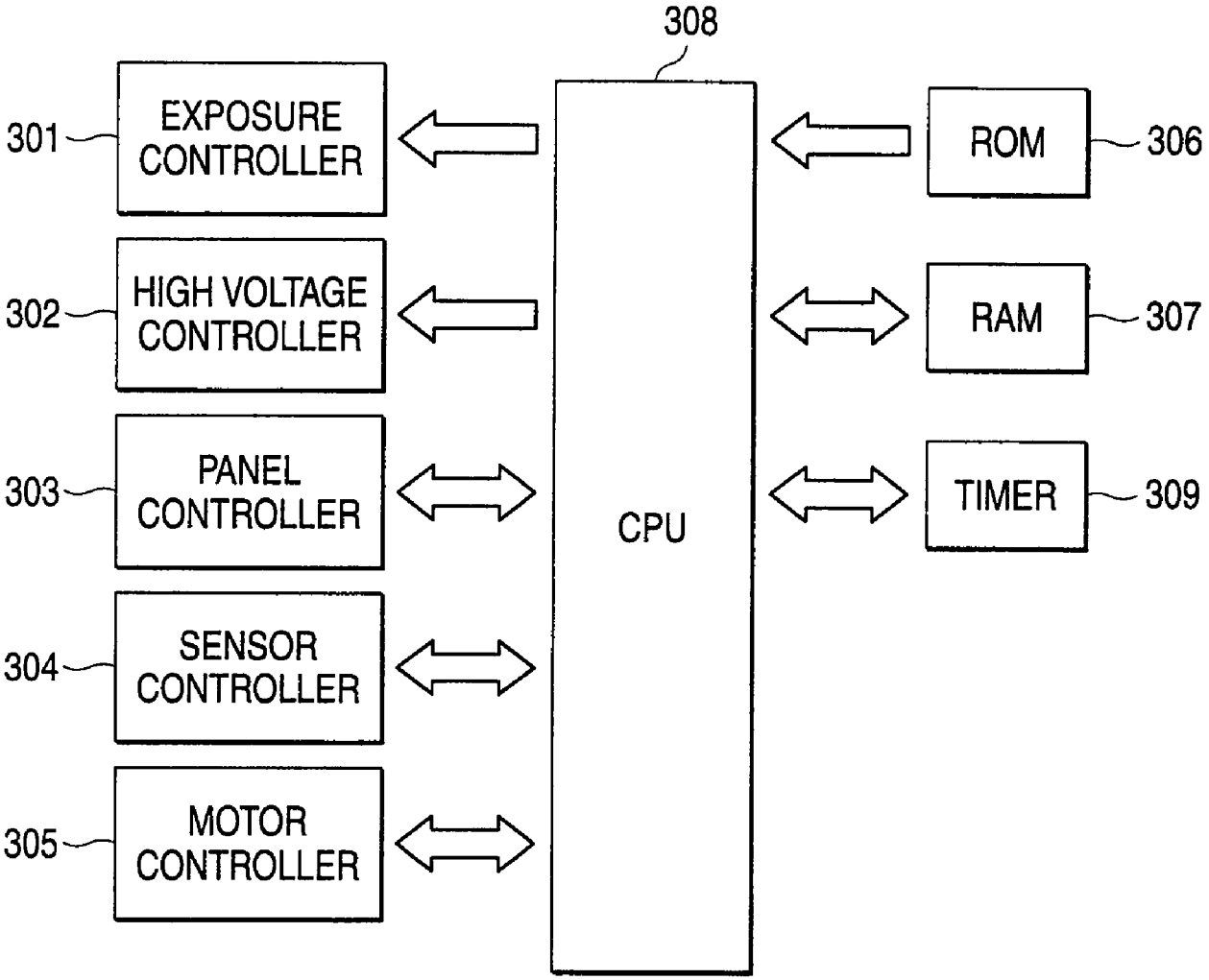
FIG. 4 is a block diagram illustrating a control system of the laser printer 1 in accordance with an exemplary embodiment of the present invention.

FIG. 4 is a block diagram illustrating a control system of the laser printer 1. An exposure controller 301 controls an operation of the scanner portion 101 and a high voltage controller 302 controls supply of high voltage power for an operation of the process cartridge 110.

A panel controller 303 is a control unit for controlling an operation panel (not illustrated) for allowing a user to operate settings. A sensor controller 304 controls the light emitting element 210 and the light receiving element 211. A motor controller 305 controls an electric motor for rotating and driving the gear structure or the heating roller 191.

A read only memory (ROM) 306 and a random access memory (RAM) 307 are unit for storing information. The ROM 306 is a read only storage device capable of storing memory content even when the provision of power is interrupted and the RAM 307 is a readable and writable storage device capable of storing information only when power is supplied.

A central processing unit (CPU) 308 is a control unit for performing an arithmetic process for controlling the exposure controller 301 and the like according to a program pre-stored in the ROM 306. A timer 309 outputs a timing signal.

Figure 5:
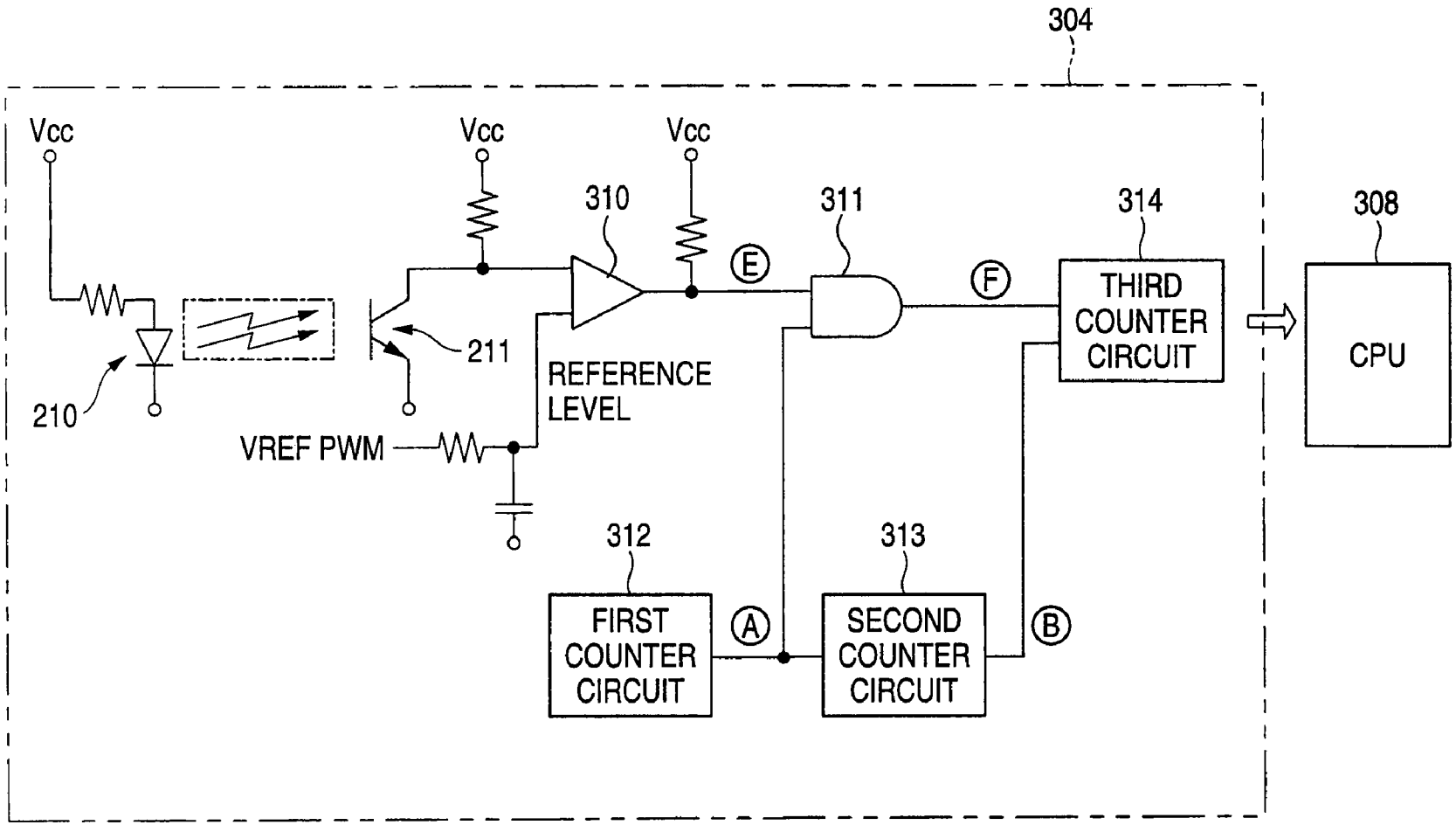
FIG. 5 is a circuit diagram illustrating an overview of a sensor control section 304 in accordance with an exemplary embodiment of the present invention.

FIG. 5 is a circuit diagram illustrating an overview of the sensor controller 304. And FIG. 6 is a time chart illustrating signal levels.

In FIG. 5, a comparator 310 compares a reference level with a signal level output from the light receiving element 211. The comparator 310 outputs a Hi signal to an AND circuit 311 when a signal level exceeds the reference level. The signal level is detected when the light receiving element receives a light. The comparator 310 outputs a Lo signal to the AND circuit 311 when the signal level is less than the reference level.

Figure 6:
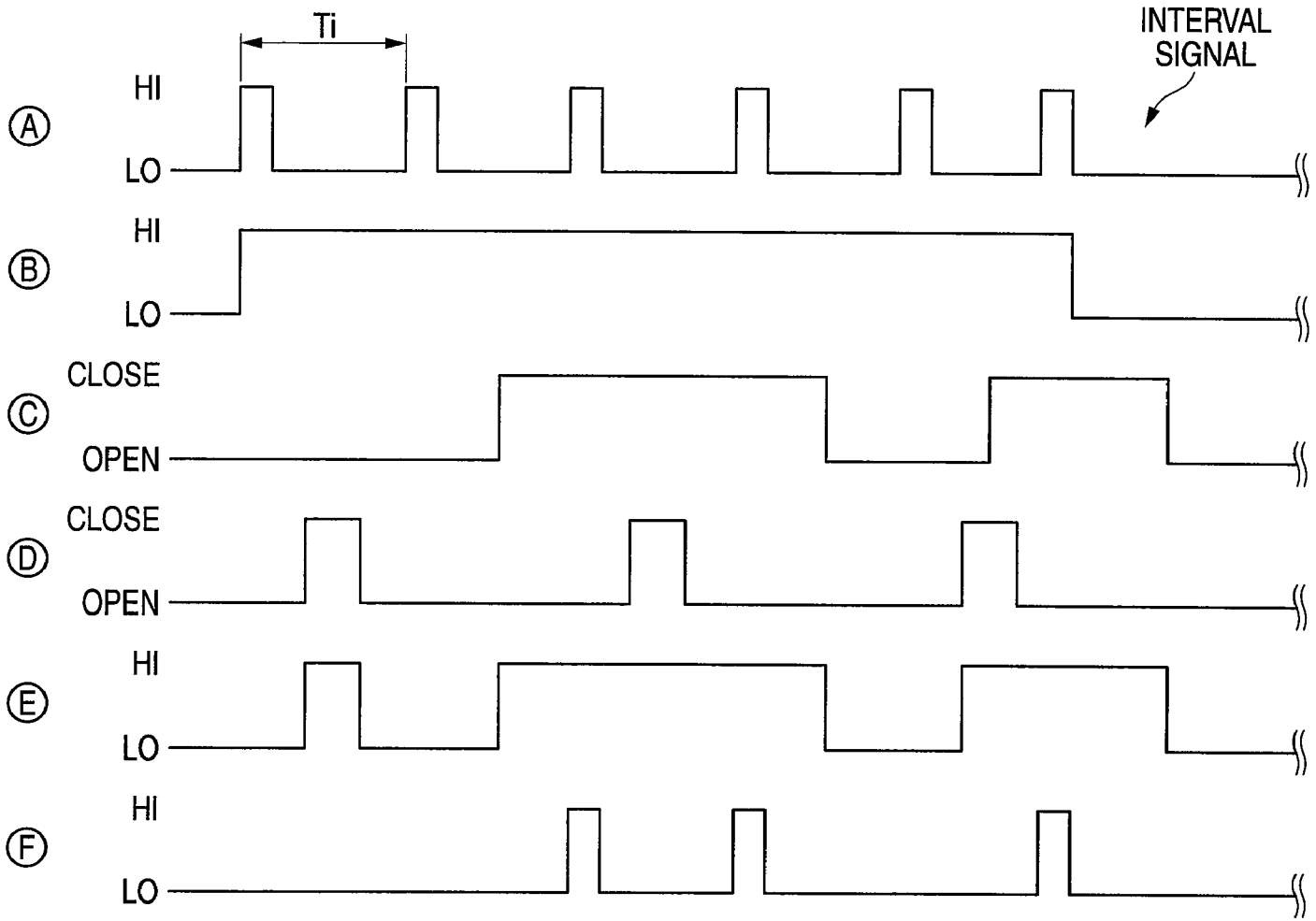
FIG. 6 is a time chart illustrating signal levels.

A first counter circuit 312 outputs an interval signal at a predefine time interval Ti (see the signal chart A of FIG. 6). The AND circuit 311 determines whether the Hi signal is output from the comparator 310 at the timing at which the interval signal is output. That is, the AND circuit 311 determines whether light is received in the light receiving element 211 when the interval signal is output.

A second counter 313 sets a predetermined number of times of outputting to one period (hereinafter, the predetermined number of times of outputting is referred to as the number of periods NI) and counts the number of times of outputting the interval signal. A third counter 314 determines an amount of the developer remaining in the casing 152 on the basis of a ratio of a count value counted by the first counter circuit 312 in one period (hereinafter, the count value is referred to as the number of times of receiving light, NR) and the number of periods NI (hereinafter, the ratio (NR/NI) is referred to as the remaining developer amount ratio).

A product of the predetermined time interval Ti and the number of periods NI (=Ti×NI) is set to an integer multiple of a time in which the agitation member 153 needs for one rotation (three times in this exemplary embodiment).

4. Characteristic Operation of Laser Printer According to an Exemplary Embodiment As illustrated in the signal chart A of FIG. 6, the first counter circuit 312 generates the Hi signal at the predetermined time interval Ti. As illustrated in the signal chart B of FIG. 6, the second counter circuit 313 generates the Hi signal in one period. That is, the second counter circuit 313 generates the Hi signal when the number of times of generating an ON signal from the first counter circuit 312 is within the number of periods NI.

A chart C illustrates timing when the developer blocks light emitted from the light emitting element 210. In this exemplary embodiment, the developer is the form of fine particle like a loose powder, the developer flows and moves in the developer casing 152 dependently and also independently to the rotation of the agitation member 153. Therefore, a waveform of the chart C in FIG. 6 is one example and is not always the same shape. A chart D illustrates timing when the agitation member 153 blocks light emitted from the light emitting element 210. In this exemplary embodiment, the agitation member 153 rotates at a constant speed. Therefore, the agitation member 153 passes across the front of a first light transmitting window 158 and the second light transmitting window 159 to block light passing through the developer casing 152 at a fixed interval.

When the agitation member 153 or the developer blocks light emitted from the light emitting element 210, the Hi signal is generated from the comparator 310 as illustrated in the signal chart E of FIG. 6. As illustrated in the signal chart F of FIG. 6, the AND circuit 311 generates the Hi signal when the signal chart A is the Hi signal and the signal chart E is the Hi signal.

When the remaining developer amount ratio is equal to or more than a predetermined value, the CPU 308 determines that an amount of the developer remaining in the casing 152 is sufficient. When the remaining developer amount ratio is less than the predetermined value, the CPU 308 determines that an amount of the developer remaining within the casing 152 is less than a predetermined amount and an alarm indicating the determination result is issued to a user.

In this exemplary embodiment, since a product of the predetermined time interval Ti and the number of periods NI is set to be an integer multiple of a time (or agitation period) required for one rotation of the agitation member 153, the number of times that light cannot be received due to the agitation member 153 (or the number of agitation influences) is constant within one period.

Since the number of agitation influences is constant in one period in this exemplary embodiment and the influence of the agitation member 153 is constant at the remaining developer amount ratio (=1/Light Receiving Ratio), the light receiving ratio accurately indicates an amount of the developer remaining in the developer casing 152. And an amount of the developer in the developer casing 152 can be accurately detected.

Since the first counter circuit 312 and the second counter circuit 313 include a programmable counter, the predetermined time interval Ti and the number of periods NI can be easily changed according to specification of the laser printer 1.

Second Embodiment

In the exemplary embodiment as described above, the predetermined time interval Ti and the number of periods NI are values fixed at the time of shipment by the manufacturer. In another exemplary embodiment, a programmable counter changes at least one of the predetermined time interval Ti and the number of periods NI on the basis of an agitation period of the agitation member 153.

Figure 7:
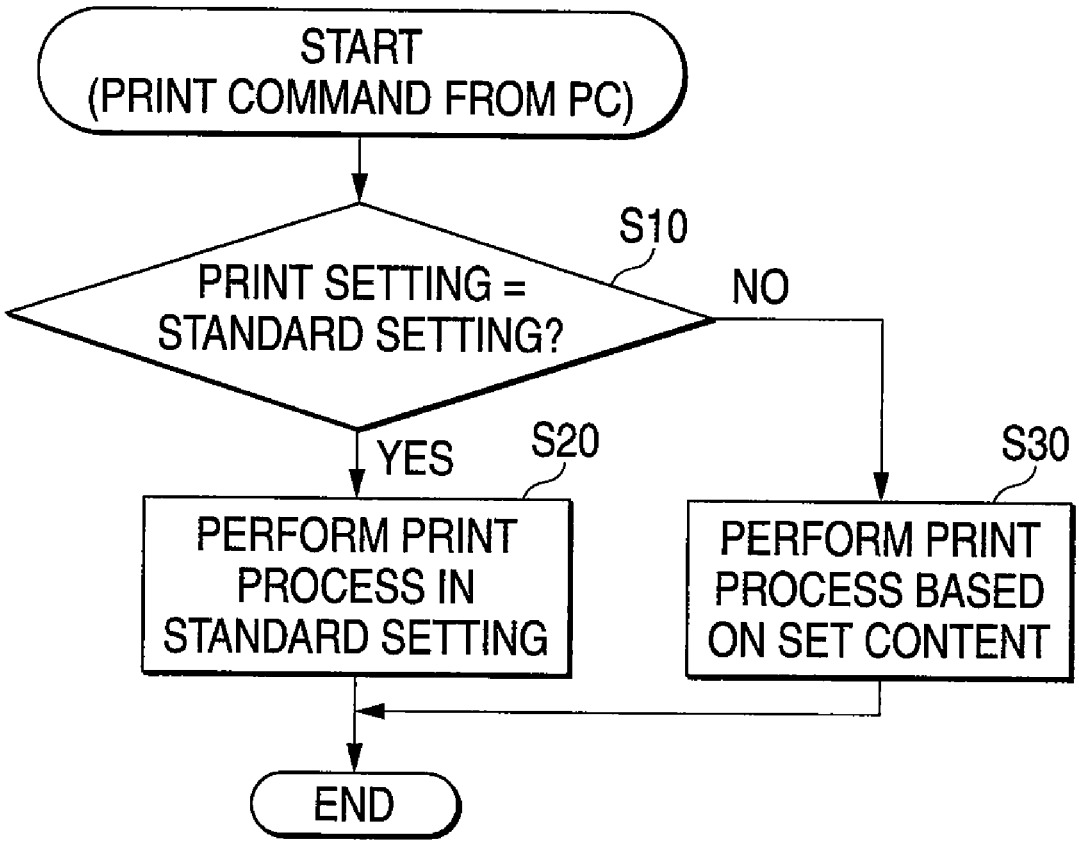
FIG. 7 is a flowchart illustrating characteristics of the laser printer 1 in accordance with another exemplary embodiment of the present invention.

FIG. 7 is a flowchart illustrating characteristics of the laser printer 1 in accordance with this exemplary embodiment. The flowchart is performed immediately before a print process is started. That is, the flowchart is performed when a print command is made from a computer (not illustrated) connected to the laser printer 1.

When the print command is made, it is determined whether a current print setting is standard print setting (S10). The current print setting can be a print setting set at the time of shipment by the manufacturer. Generally, this setting is set on the basis of a standard printing rate of the laser printer 1, the thickness of a normal printing sheet.

When the current print setting is determined to be standard print setting (S10: YES), a print process is performed in standard print setting (S20). Upon determining that the current print setting is not standard print setting (S10: NO), the print process is performed on the basis of set content (S30).

A change of print setting is performed when the user operates the computer connected to the laser printer 1. Since the printing rate and the rotation rate of the agitation member 153 are changed in conjunction with each other, the number of periods NI is changed to be small when the printing rate is fast. On the other hand, since the printing rate is generally slow when the printing sheet is thick, the number of periods NI is changed to be small.

Therefore, in this exemplary embodiment, the predetermined time interval Ti and the number of periods NI can be set to values proper for a changed rotation rate even when the rotation rate of the agitation member 153 is changed.

Other Exemplary Embodiments

The present invention is applied to the laser printer in the exemplary embodiments as described above, but is not limited thereto. The present invention can be also applied to a copy machine.

As described above, the first counter circuit 312 and the second counter circuit 313 are constructed with a programmable counter in the exemplary embodiments. But the present invention is not limited thereto. The present invention may be otherwise embodied within the scope of the following claims, but is not limited thereto.

For example, if at least one of the signal output unit and the counting unit includes a programmable counter as described above, at least one of the predetermined time interval and the number of times of outputting may be easily changed according to specifications of the image forming apparatus.

A setting change unit may be provided to change at least one of the predetermined time interval and the predetermined number of times of outputting on the basis of the time required for the one rotation of the agitation member.

Therefore, any one of the predetermined time interval and the predetermined number of times of outputting may be set to a value which is proper for a varied rotation rate even when the rotation rate of the agitation member is varied.

What is claimed is:

1. An image forming apparatus for forming an image on a recording sheet by transferring a developer image to the recording sheet, the apparatus comprising:

a developer casing which accommodates a developer;

an agitation member, provided to be rotated in the developer casing, which agitates the developer;

a light emitting unit, arranged at one end in a rotation axis direction of the agitation member, which emits light to the other end in the rotation axis direction of the agitation member through the developer casing;

a light receiving unit, arranged at the other end in the rotation axis direction of the agitation member, which receives the light emitted from the light emitting unit;

a signal output unit which outputs an interval signal at a predetermined time interval;

a light reception determination unit which determines whether light has been received in the light receiving unit when the interval signal has been output;

a counting unit which sets a predetermined number of times of outputting to one period and counts a number of times the interval signal is output;

a remaining amount determination unit which determines an amount of the developer remaining in the developer casing on a basis of a ratio of a number of times of determining, by the light reception determination unit, that light has been received in the light receiving unit within the one period and the predetermined number of times of outputting, wherein a product of the predetermined time interval and the predetermined number of times of outputting is set to be an integer multiple of a time required for one rotation of the agitation member; and a setting change unit which changes at least one of the predetermined time interval and the predetermined number of times of outputting on a basis of the time required for the one rotation of the agitation member.

2. The image forming apparatus according to claim 1, wherein at least one of the signal output unit and the counting unit comprises a programmable counter.

* * * * *